US006273333B1

(12) United States Patent
Ward

(10) Patent No.: US 6,273,333 B1
(45) Date of Patent: Aug. 14, 2001

(54) COMBINATION COASTER AND CUP HOLDER

(76) Inventor: Eric Ward, 11150 Glenoaks Blvd. Unit #255, Pacoima, CA (US) 91331

( * ) Notice: Subject to any disclaimer, the term of this patent is extended or adjusted under 35 U.S.C. 154(b) by 0 days.

(21) Appl. No.: 09/684,900

(22) Filed: Oct. 10, 2000

(51) Int. Cl.[7] ..... B65D 3/28

(52) U.S. Cl. ..... 229/402; 220/738; 220/739; 220/758; 229/403

(58) Field of Search ..... 229/402, 403; 220/737, 738, 739, 753, 758, 903

(56) References Cited

U.S. PATENT DOCUMENTS

| | | | | |
|---|---|---|---|---|
| 1,866,805 | * | 7/1932 | Haywood | 220/737 |
| 2,060,781 | * | 11/1936 | Annen | 229/402 |
| 4,685,583 | * | 8/1987 | Noon | 220/758 |
| 4,938,411 | * | 7/1990 | Rizzuto | 220/738 |
| 5,205,473 | * | 4/1993 | Coffin, Sr. | 229/403 |
| 5,445,315 | * | 8/1995 | Shelby | 220/903 |
| 5,857,615 | * | 1/1999 | Rose | 229/403 |
| 5,868,310 | * | 2/1999 | Leszczynski | 229/402 |
| 6,026,983 | * | 2/2000 | Graham | 220/738 |
| 6,032,826 | * | 3/2000 | Llbit et al. | 220/738 |
| 6,116,503 | * | 9/2000 | Varano | 229/402 |

* cited by examiner

*Primary Examiner*—Gary E. Elkins
(74) *Attorney, Agent, or Firm*—David A. Belasco; Beehler & Pavitt

(57) ABSTRACT

A combination coaster and cup holder is constructed from a planar panel formed from thin, flexible material. The panel has an upper surface and a lower surface, a top edge, a bottom edge, a first side edge and a second side edge. A slit extends from the upper surface to the lower surface between the top edge and the bottom edge, and extends from a point adjacent the first side edge to a point adjacent the second side edge. The slit has an upper edge, a lower edge, a first end and a second end. The slit has a length equal to one half the circumference of a tapered cup measured at a point between the upper rim of the cup and the base. The panel is folded along the slit and the upper edge is separated from the lower edge and the cup is introduced between the edges form a cup holder located about the circumference of the cup. The cup holder will fit frictionally about the cup between the rim and the base, adapting automatically to the taper of the cup. First and second stress-relief orifices are circular cut-out openings or perpendicular cuts located at the ends of the slit. The lower surface of the panel includes insulating material to prevent transmission of either heat or cold through the panel. Cuts perpendicular to the slit permit the cup holder to conform to the curved surface of the cup. The panel is a formed as one-piece, planar, paperboard blank.

17 Claims, 2 Drawing Sheets

COMBINATION COASTER AND CUP HOLDER

FIELD OF INVENTION

The invention pertains to beverage container handling. More particularly, the invention relates to a combination coaster and cup holder that may be formed from sheet material.

BACKGROUND OF THE INVENTION

Various designs have been developed for cup holders formed from various materials and coasters in one form or another have been in common use for a considerable period. U.S. Pat. No. 6,032,826 issued to Libit et al. is cup holder formed from a single sheet of paperboard or similar material with a slit cut through a central portion of the sheet. The sheet is folded about the slit and along crease lines extending from the slit to provide an opening for a cup. The edges of the slit bear against the cup lip to support it. Edges of the cup holder opposite the slit provide a platform upon which the cup is supported on a horizontal surface.

U.S. Pat. No. 5,445,315 issued to Shelby, is for a beverage sleeve formed from substantially rigid paperboard sheet. The sheet includes a number of creases that allow it to be folded into a rectangular sleeve. A bottom portion is included that spans the lower portion of the sleeve to prevent a beverage container from sliding through the sleeve.

U.S. Pat. No. 6,026,983, issued to Graham describes a combination beverage container sleeve and coaster formed from a single sheet of cardboard or similar material. The sheet is scored and folded to form a hexagonal sleeve. A hexagonal "coaster portion" is attached to the lower edge of the sheet and fastens across the bottom of the sleeve to prevent damage to surfaces upon which the container is placed. U.S. Pat. No. 5,857,615 issued to Rose discloses a container holder formed from a single sheet of material. The sheet has a pair of tabs die-cut into one end of the sheet and a pair of slits cut into the opposite end. The holder wraps around a beverage container and the tabs are inserted into the slits to fasten the holder in place. U.S. Pat. No. 5,205,473 issued to Coffin, Sr. describes a truncated cone-shaped beverage container holder formed of corrugated material to insulate the user's hand from hot or cold beverages. The patent also discloses an integral beverage container and holder of similar construction.

While other variations exist, the above-described designs for beverage container holders and coasters are typical of those encountered in the prior art. It is an objective of the present invention to provide a combination coaster and cup holder that can be constructed from a minimal amount of material. It is a further objective to provide a cup holder adaptable to cups of a variety of sizes and configurations. It is a further objective to provide a cup holder and coaster that will insulate the user and delicate surface from heat, cold, and moisture. It is a still further objective of the invention to provide a cup holder that can be easily and quickly attached to a cup with minimal assembly. It is yet a further objective to provide a combination coaster and cup holder that is capable of displaying advertising. Finally, it is an objective of the invention to provide a cup holder that will conform easily to the curved shape of a cup.

While some of the objectives of the present invention are disclosed in the prior art, none of the inventions found include all of the requirements identified.

SUMMARY OF THE INVENTION

The present invention addresses all of the deficiencies of prior coasters and cup holders and satisfies all of the objectives described above.

A combination coaster and cup holder providing the desired features may be constructed as follows. A planar panel formed from thin, flexible material is provided. The panel has an upper surface and a lower surface, a top edge, a bottom edge, a first side edge and a second side edge. A slit extends from the upper surface to the lower surface. The slit is located between the top edge and the bottom edge, and extends from a point spaced inwardly from the first side edge to a point spaced inwardly from the second side edge. The slit has an upper edge, a lower edge, a first end and a second end. The slit has a length equal to one half of a circumference of a tapered cup for which the cup holder is intended. The circumference is measured at a point between an upper rim of the cup and a base of the cup.

In use, when the combination coaster and cup holder is placed beneath the cup it will serve as a coaster. When the combination coaster and cup holder is folded along the slit and the upper edge is separated from the lower edge and the cup is introduced between the upper edge and the lower edge from the upper surface, the panel will form a cup holder located about the circumference of the cup. The cup holder will fit frictionally about the cup between the rim and the base, adapting automatically to a taper of the cup.

In a variant of the invention, first and second stress-relief orifices are provided. The first and second orifices are circular cut-out openings located at the first and second ends of the slit, respectively. The orifices serve to prevent tearing of the planar panel when the cup is introduced between the upper edge and the lower edge from the upper surface.

In a further variant of the invention, first and second stress-relief cuts are provided. The first and second cuts are perpendicular to and extend from at least one edge of the first and second ends of the slit, respectively. The cuts serve to prevent tearing of the planar panel when the cup is introduced between the upper edge and the lower edge from the upper surface.

In still a further variant, the lower surface of the combination coaster and cup holder includes insulating material to prevent transmission of either of heat and cold through the panel.

In yet another variant of the invention, the panel is formed of corrugated paperboard and corrugations are located upon the lower surface of the panel.

In another variant, the planar panel includes a series of cuts. The cuts are perpendicular to the slit and extend from points spaced downwardly from the top edge to points spaced upwardly from the upper edge of the slit and from points spaced downwardly from the lower edge of the slit to points spaced upwardly from the bottom edge. The cuts permit the cup holder to conform to a curved surface of the cup.

In still another variant, the planar panel is formed from material selected from the group comprising: paperboard, cardboard, plastic, cellulose fiber and wood.

In a final variant of the invention, the combination coaster and cup holder is formed from a one-piece, planar, paperboard blank.

An appreciation of the other aims and objectives of the present invention and an understanding of it may be achieved by referring to the accompanying drawings and the detailed description of a preferred embodiment.

DETAILED DESCRIPTION OF THE PREFERRED EMBODIMENT

Figure 6:
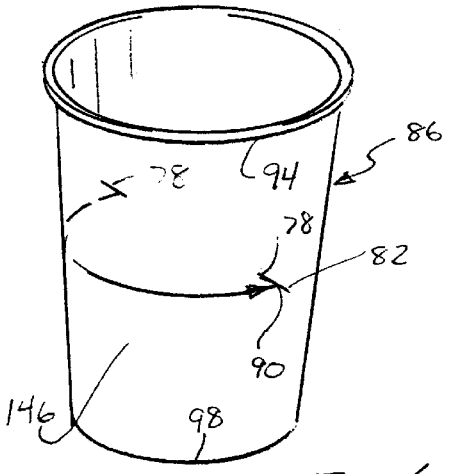
FIG. 6 is a perspective view of a cup for use with the FIG. 1 embodiment illustrating a circumference of said cup.
Figure 5:
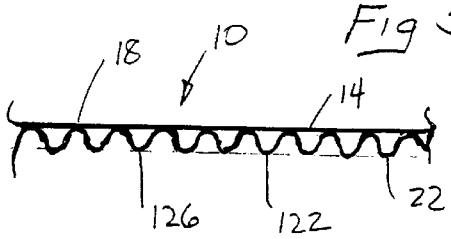
FIG. 5 is a cross-sectional view of the FIG. 1 embodiment taken along the line 5—5.

FIGS. 1–8 illustrate a combination coaster and cup holder 10 providing the desired features may be constructed as follows. A planar panel 14 formed from thin, flexible material is provided. The panel 14 has an upper surface 18 and a lower surface 22, a top edge 26, a bottom edge 30, a first side edge 34 and a second side edge 38. A slit 42 extends from the upper surface 18 to the lower surface 22. The slit 42 is located between the top edge 26 and the bottom edge 30, and extends from a point 54 spaced inwardly from the first side edge 34 to a point 58 spaced inwardly from the second side edge 38. As illustrated in FIG. 6, the slit 42 has an upper edge 62, a lower edge 66, a first end 70 and a second end 74. The slit 42 has a length 78 equal to one half of a circumference 82 of a tapered cup 86 for which the cup holder 10 is intended. The circumference 82 is measured at a point 90 between an upper rim 94 of the cup 86 and a base 98 of the cup 86.

Figure 1:
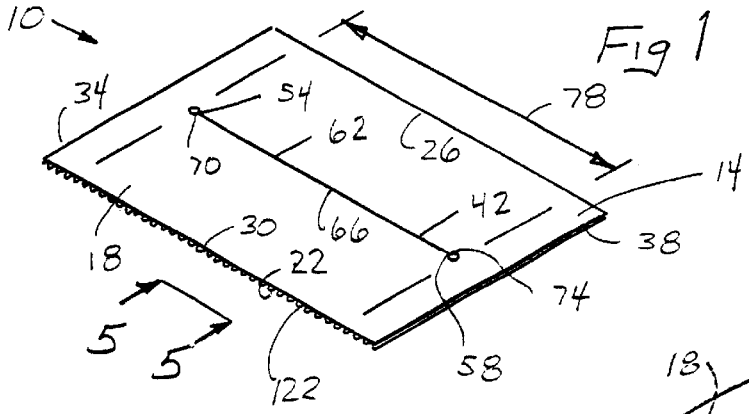
FIG. 1 is a perspective view of the preferred embodiment of the invention in the coaster configuration and illustrating stress-relief orifices at the ends of the slit.
Figure 2:
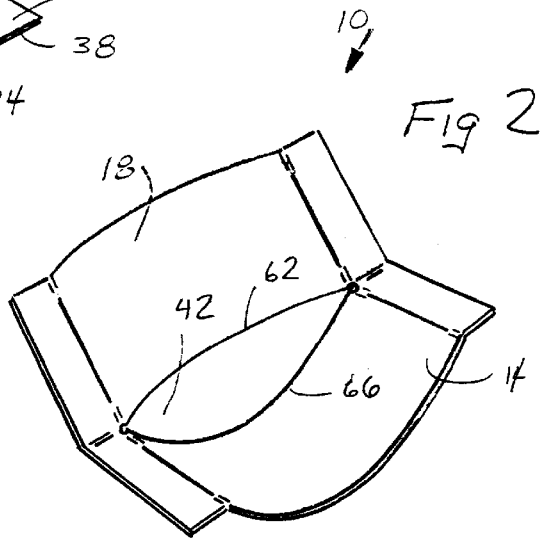
FIG. 2 is a perspective view of the FIG. 1 embodiment showing the opening of the slit for use as a cup holder.
Figure 3:
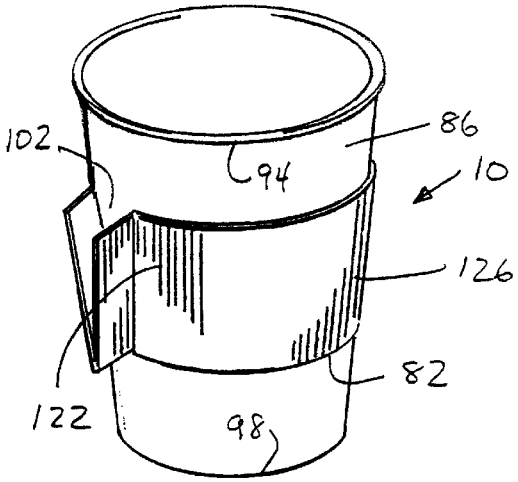
FIG. 3 is a perspective view of the FIG. 1 embodiment disposed about a tapered cup.

In use, when the combination coaster and cup holder 10 is placed beneath the cup 86 it will serve as a coaster. As illustrated in FIGS. 2 and 3, when the combination coaster and cup holder 10 is folded along the slit 42 and the upper edge 62 is separated from the lower edge 66 and the cup 86 is introduced between the upper edge 62 and the lower edge 66 from the upper surface 18, the panel 14 will form a cup holder 10 located about the circumference 82 of the cup 86. The cup holder 10 will fit frictionally about the cup 86 between the rim 94 and the base 98, adapting automatically to a taper 102 of the cup 86.

Figure 4:
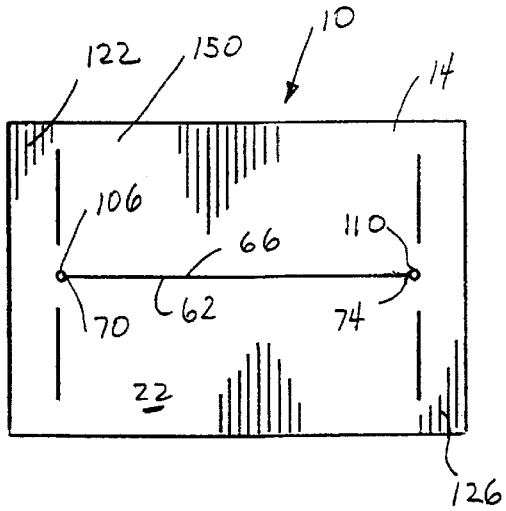
FIG. 4 is a bottom plan view of the FIG. 1 embodiment illustrating a corrugated surface for temperature insulation.

In a variant of the invention, as illustrated in FIG. 4, first 106 and second 110 stress-relief orifices are provided. The first 106 and second 110 orifices are circular cut-out openings located at the first 70 and second 74 ends of the slit, respectively. The orifices 106, 110 serve to prevent tearing of the planar panel 14 when the cup 86 is introduced between the upper edge 62 and the lower edge 66 from the upper surface 18.

Figure 7:
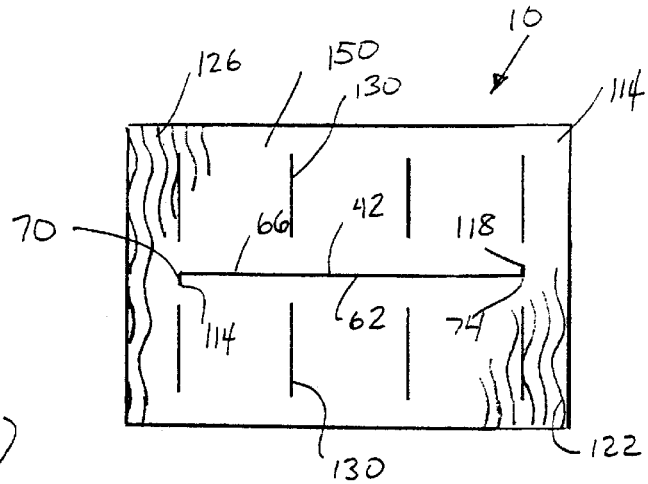
FIG. 7 is a bottom plan view of a second embodiment illustrating a wave-form corrugated surface for temperature insulation, an alternative design for stress relief for the slit and additional cuts to conform the cup holder to the curved surface of the cup.

In a further variant of the invention, as illustrated in FIG. 7, first 114 and second 118 stress-relief cuts are provided. The first 114 and second 118 cuts are perpendicular to and extend from at least one edge 62, 66 of the first 70 and second 74 ends of the slit 42, respectively. The cuts 114, 118 serve to prevent tearing of the planar panel 14 when the cup 86 is introduced between the upper edge 62 and the lower edge 66 from the upper surface 18.

In still a further variant, as illustrated in FIGS. 1 and 3–5, the lower surface 22 of the combination coaster and cup holder 10 includes insulating material 122 to prevent transmission of either of heat and cold through the panel 14.

In yet another variant of the invention, the panel 14 is formed of corrugated paperboard and corrugations 126 are located upon the lower surface 22 of the panel 14.

Figure 8:
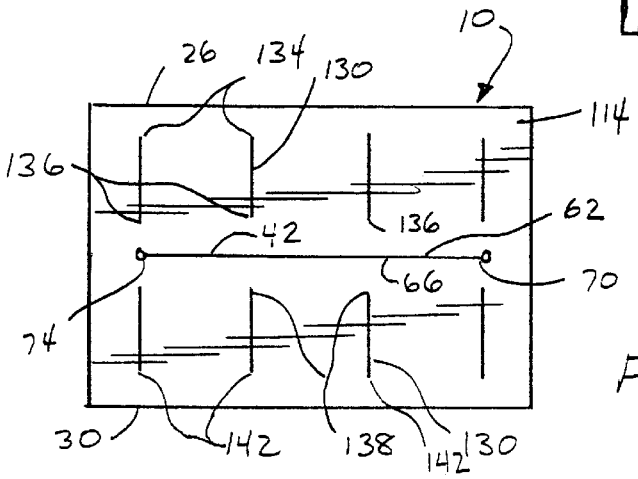
FIG. 8 is a top plan view of a third embodiment illustrating a coaster formed of an uncorrugated material also illustrating additional cuts to conform the cup holder to the curved surface of the cup.

In another variant, as illustrated in FIGS. 7 and 8, the planar panel 14 includes a series of cuts 130. The cuts 130 are perpendicular to the slit 42 and extend from points 134 spaced downwardly from the top edge 26 to points spaced upwardly from the upper edge 62 of the slit 42 and from points 138 spaced downwardly from the lower edge 66 of the slit 42 to points 142 spaced upwardly from the bottom edge 30. The cuts 130 permit the cup holder 10 to conform to a curved surface 146 of the cup 86.

In still another variant, as illustrated in FIG. 8, the planar panel 14 is formed from material selected from the group comprising: paperboard, cardboard, plastic, cellulose fiber and wood.

In a final variant of the invention, as illustrated in FIGS. 4 and 7, the combination coaster and cup bolder 10 is formed from a one-piece, planar, paperboard blank 150. The combination coaster and cup holder 10 has been described with reference to particular embodiments. Other modifications and enhancements can be made without departing from the spirit and scope of the claims that follow.

What is claimed is:

1. A combination coaster and cup holder, comprising:

a planar panel, said panel being formed from thin, flexible material and having an upper surface and a lower surface;

said panel having a top edge, a bottom edge, a first side edge and a second side edge;

a slit, said slit extending from the upper surface to the lower surface, being disposed between the top edge and the bottom edge, and extending from a point spaced inwardly from the first side edge to a point spaced inwardly from the second side edge;

said slit having an upper edge, a lower edge, a first end and a second end;

said slit having a length equal to one half of a circumference of a tapered cup for which the cup holder is intended, said circumference being measured at a point between an upper rim of the cup and a base of the cup; and whereby, when the combination coaster and cup holder is placed beneath the cup it will serve as a coaster and when the combination coaster and cup holder is folded along the slit and the upper edge is separated from the lower edge and the cup is introduced between the upper edge and the lower edge from the upper surface, the panel will form a cup holder disposed about the circumference of the cup, said cup holder fitting frictionally about the cup between the rim and the base and adapting automatically to the taper of the cup.

2. A combination coaster and cup holder as described in claim 1, further comprising:

first and second stress-relief orifices, said first and second orifices being circular cut-out openings disposed at the first and second ends of the slit, respectively; and said orifices serving to prevent tearing of the planar panel when the cup is introduced between the upper edge and the lower edge from the upper surface.

3. A combination coaster and cup holder as described in claim 2 wherein the planar panel is formed from material selected from the group comprising:

paperboard, cardboard, plastic, cellulose fiber and wood.

4. A one-piece, planar, paperboard blank for forming combination coaster and cup holder of claim 2.

5. A combination coaster and cup holder as described in claim 1, further comprising:

first and second stress-relief cuts, said first and second cuts being perpendicular to and extending from at least one edge of the first and second ends of the slit, respectively; and said cuts serving to prevent tearing of the planar panel when the cup is introduced between the upper edge and the lower edge from the upper surface.

6. A combination coaster and cup holder as described in claim 5 wherein the planar panel is formed from material selected from the group comprising:

paperboard, cardboard, plastic, cellulose fiber and wood.

7. A one-piece, planar, paperboard blank for forming combination coaster and cup holder of claim 5.

8. A combination coaster and cup holder as described in claim 1 wherein the lower surface further comprises insulating material to prevent transmission of either of heat and cold through the panel.

9. A combination coaster and cup holder as described in claim 8 wherein the planar panel is formed from material selected from the group comprising:

paperboard, cardboard, plastic, cellulose fiber and wood.

10. A one-piece, planar, paperboard blank for forming combination coaster and cup holder of claim 8.

11. A combination coaster and cup holder as described in claim 8 wherein the panel is formed of corrugated paperboard and corrugations are disposed upon the lower surface of the panel.

12. A one-piece, planar, paperboard blank for forming combination coaster and cup holder of claim 11.

13. A combination coaster and cup holder as described in claim 1, further comprising a series of cuts, said cuts being perpendicular to the slit and extending from points spaced downwardly from the top edge to points spaced upwardly from the upper edge of the slit and from points spaced downwardly from the lower edge of the slit to points spaced upwardly from the bottom edge, said cuts permitting the cup holder to conform to the curved surface of the cup.

14. A combination coaster and cup holder as described in claim 13 wherein the planar panel is formed from material selected from the group comprising:

paperboard, cardboard, plastic, cellulose fiber and wood.

15. A one-piece, planar, paperboard blank for forming combination coaster and cup holder of claim 13.

16. A combination coaster and cup holder as described in claim 1 wherein the planar panel is formed from material selected from the group comprising:

paperboard, cardboard, plastic, cellulose fiber and wood.

17. A one-piece, planar, paperboard blank for forming combination coaster and cup holder of claim 1.

* * * * *